US007018266B2

(12) United States Patent
Sinisi

(10) Patent No.: US 7,018,266 B2
(45) Date of Patent: Mar. 28, 2006

(54) LAND SAIL VEHICLE

(76) Inventor: John J. Sinisi, 1465 Stony Rd., Warminster, PA (US) 18974

( * ) Notice: Subject to any disclaimer, the term of this patent is extended or adjusted under 35 U.S.C. 154(b) by 11 days.

(21) Appl. No.: 10/913,390

(22) Filed: Aug. 9, 2004

(65) Prior Publication Data

US 2005/0287922 A1 Dec. 29, 2005

Related U.S. Application Data

(60) Provisional application No. 60/581,709, filed on Jun. 23, 2004.

(51) Int. Cl.
*A63H 30/04* (2006.01)

(52) U.S. Cl. ..... 446/456; 446/154; 244/16

(58) Field of Classification Search ..... 446/154, 446/454, 456; 244/16
See application file for complete search history.

(56) References Cited

U.S. PATENT DOCUMENTS 3,572,740 A 3/1971 Rypinski
3,909,276 A * 9/1975 Wolf ..... 446/454
4,049,287 A 9/1977 Dudouyt
4,332,395 A 6/1982 Zech
4,408,772 A 10/1983 Hollwarth
4,426,806 A 1/1984 Woodworth
4,655,724 A * 4/1987 Law ..... 446/443
4,886,478 A 12/1989 Jones
6,551,169 B1 * 4/2003 Jaffe ..... 446/462
6,579,146 B1 6/2003 Ganz

* cited by examiner

*Primary Examiner*—Kien Nguyen
(74) *Attorney, Agent, or Firm*—Gregory J. Gore

(57) ABSTRACT

A tricycle-type wind-propelled toy land vehicle includes a sail with reliable tangle-free boom control. Both the disposition of the boom and the front wheel steering is actuated by a radio frequency remote control system. The vehicle further includes a skid plate surrounding the front wheel to prevent tip-over. The front wheel is steered by a worm gear drive which is self-locking. Boom control is provided by a guided cable system or, in an alternate embodiment, a direct gear drive to rotate the mast. In yet another embodiment, boom control is provided by a sliding leaf spring which passes underneath the boom and attaches to a track on the underside of the boom.

14 Claims, 7 Drawing Sheets

LAND SAIL VEHICLE

The present application is related to provisional patent application Ser. No. 60/581,709 entitled "Land Sail Vehicle" filed on Jun. 23, 2004, priority from which is hereby claimed.

FIELD OF THE INVENTION

The present invention relates to a wind-propelled toy vehicle. More specifically it relates to a radio-controlled wheeled land vehicle which carries a sail.

BACKGROUND OF THE INVENTION AND PRIOR ART

There are many types of wind-propelled toys and large scale recreational vehicles that are land vehicles. Land vehicles of this type include a sail for capturing the wind and wheels to support a vehicle frame which carries the sail. Typically these vehicles are of tricycle-type construction with two widely spaced apart rear wheels mounted on a rear axle and a single steerable front wheel. It is further known to have toy vehicles of this type radio-controlled. A servo/receiver mounted on the vehicle receives radio frequency signals from a controller. A receiver with servomotors in turn regulates a steering mechanism for the front wheel and drive means to orient the sail with respect to the vehicle frame.

A problem with vehicles of this type is their tendency to tip over uncontrollably in a strong wind. Various attempts to mitigate the tip-over problem have included flexible outrigger wheels, special weight distribution, and positioning the center of gravity of the vehicle with respect to the wheels. Unfortunately these attempts to provide a stable vehicle which will operate at high speed without tipping over have not been completely successful. Furthermore, string boom controllers which have been used to replicate sailboat-type maneuvering have a problem because the string becomes loose when the boom swings from one side to another and the string length control mechanism, usually a spool or winch-type drum, can cause the string to tangle thus disabling the boom control system.

Boom control and steering control are key to stable high speed operation of toy vehicles of this type. Pertinent U.S. Patent prior art of which the applicant is aware includes U.S. Pat. No. 4,886,478 issued to Jones and U.S. Pat. No. 6,579,146 issued to Ganz. The patent to Jones describes a boom having its movement restricted by a loose string and a front wheel steering mechanism comprising a pair of cables which extend from a rearwardly-mounted servomotor to the forward steered wheel. The patent to Ganz discloses an unguided string-controlled boom and a wire extending to a control arm on the front wheel from the servomotor for steering the front wheel. Neither of these systems for steering and boom control provide the degree and accuracy for stable high speed operation of a wind-propelled toy vehicle. Also, neither reference discloses any means for preventing the vehicle from tipping over.

There is therefore a need for a wind-propelled toy vehicle of the radio-controlled type which can operate controllably and travel at high speeds without tipping over. The vehicle should also be inexpensive to manufacture and be of rugged construction with a high degree of operational reliability.

SUMMARY OF THE INVENTION

In order to overcome the stability and vehicle tip-over problems with prior art tricycle-type wind-propelled land vehicles, the present invention has been devised. The invention includes various novel components including a worm-gear driven front steering wheel, several concepts to provide unique boom position control, and a skid plate which surrounds both sides of the front wheel steering assembly.

The ideal boom control mechanism should allow the boom to be quickly but smoothly positioned so that abrupt forces are not exerted on the vehicle. String-type boom control is preferred, but because the boom can swing freely, it can also apply an undesirable jerk force to the vehicle and tangle, disabling the vehicle as described above. Three novel embodiments for improving the sail boom control which will be described in greater detail herein employ either a guided cable, a gear and pinion, or a sliding leaf spring mechanism.

Briefly described, the guided cable system provides the loose boom realism of sailboat-type maneuvering for the land vehicle while controlling the position of a main portion of the string or cable so that it cannot tangle. This is provided by a guide sleeve through which the string or cable passes utilized in combination with a linear rack also in a guided sleeve and a meshing pinion gear to pull the end of the string. The second boom control mechanism is a main gear and pinion assembly affixed to the mast or boom. The main gear may be affixed directly to the mast or the boom and positioned to mesh with a pinion gear mounted to the end of the servomotor shaft or a gearbox. In this embodiment, the position of the boom is accurately controlled with or without freedom of movement which may be provided by a mechanical construction which allows free play between the controlled motion of the gears and the boom. A third embodiment employs a sliding leaf spring or band which passes underneath the boom and attaches to a track on the underside of the boom. The end of the band carries a shoe which rides on the track. A rack and pinion linear slide mechanism moves the opposite end of the band. By changing the operative length of the band, the restorative spring force which returns the boom to its center position can be varied from one in which there is high resistance to boom deflection by the wind to one in which the boom is allowed to move considerably to one side or the other. This results in the ability to control the position of the sail. All three concepts will be described in greater detail and are further illustrated in the drawings which follow.

The front wheel steering mechanism is another novel aspect of the invention which includes a self-locking function provided by a worm gear drive mechanism. The front wheel is turned in response to this mechanism, however reaction forces on the wheel cannot turn the mechanism backward because it lacks the ability to reverse the direction of force transfer. Thus, the front wheel is accurately held in the position established by a servomotor, for example an inexpensive DC motor, according to the controller input. The mechanism which accomplishes this is a worm gear mechanism which is turned by a drive shaft. The drive shaft extends from the front of the vehicle rearward to the servomotor and electronics which are placed at the rear for better vehicle balance. Another benefit of this system is that the front wheel can be steered 90 degrees in either direction giving a full 180 degrees of steering. Most prior art systems steer only 45 degrees in either direction or 90 degrees overall. Providing 180 degree steering allows for sharper turns and greater maneuverability.

Yet another novel aspect of the invention is a skid plate which is operational when the vehicle tips or heels too far to one side. The skid plate includes side rails that contact the ground when the vehicle leans too far over. The geometry of the skid plate together with the wheel geometry of the vehicle causes the front wheel to lift from the ground when there is ground contact with a side rail of the skid plate. Because the side rail exerts less lateral force on the vehicle compared to the front wheel because of its lower coefficient of friction, the vehicle slides on the skid plate quickly rotating in the downwind direction. This immediately reduces the force of the wind on the sail and the vehicle is quickly righted before it tips over completely.

More specifically, the applicant has invented a remote-controlled wind propelled land vehicle comprising a frame having a rear portion including means for mounting two spaced apart coaxially aligned rear wheels, means at a front portion of the frame for mounting a single steerable front wheel, the rear wheels and the front wheel providing rolling support for the frame along a ground surface, a steering mechanism mounted to the frame for turning the front wheel about a substantially vertical axis, remote control means including a receiver responsive to remote control signals mounted upon a rear portion of the frame for driving the steering mechanism, a mast mounted to the frame for supporting an upright wind sail assembly including a swingably mounted boom connected to the mast and a sail, and the remote control means further comprising at least one motor for steering the front wheel and further including means for manipulating the boom in response to control signals generated by a remote control sending unit. The steering mechanism comprises a forwardly-extending rotatable drive shaft having a worm gear at a forward end thereof meshing with a planetary gear of the steering mechanism, the drive shaft having a rearward end connected to said remote control means. Means for manipulating the boom include an extendable and retractable leaf spring. The remote control means includes drive means between at least one motor and the leaf spring for extending and retracting the leaf spring forwardly and rearwardly beneath the boom. The vehicle has a coupling slidably connected to the boom at one end and rigidly connected to a distal end of the spring at the other end whereby retracting and extending the spring resiliently restricts lateral movement of the boom to a greater or lesser degree. The boom manipulating means includes a guided cable which passes through a tubular guide along a substantial portion of its length, the cable being attached to the boom at one end and attached to the remote control means at a second end thereof. The tubular guide is a substantially circular cross-section and affixed to the frame. The boom is swingably mounted to the mast and the mast is pivotably mounted to the frame. The vehicle includes a partially restrictive rotatable joint between the boom and the mast, the joint having an arcuate slot in a collar which surrounds the mast and which is rigidly connected to the boom and a pin rigidly affixed to the mast which projects laterally through the slot whereby the pin engages ends of the slot when the boom swings from one side to the other about the mast. The means for manipulating the boom includes first gear means affixed to the mast in meshing cooperation with second gear means connected to the remote control means. The first gear means is connected to the mast along a bottom portion thereof. The means for manipulating the boom also includes a DC electric motor. The planetary gear lies substantially in a horizontal plane and includes teeth which surround the front wheel on all sides. A skid plate is affixed to the frame located proximate the front wheel and includes left side and right side surfaces which are ground engagable when the vehicle is traveling in a heeled-over condition, each surface extending laterally beyond a line between the front wheel and each rear wheel.

These unique aspects of the invention create an extremely enjoyable and entertaining radio-controlled toy vehicle which is easy to use. The construction materials and methods used also provide a toy which is economical to manufacture and very durable. Other objects and advantages of the invention will be readily apparent from the following drawings and specific description of the preferred embodiment.

DESCRIPTION OF THE PREFERRED EMBODIMENT

Figure 1:
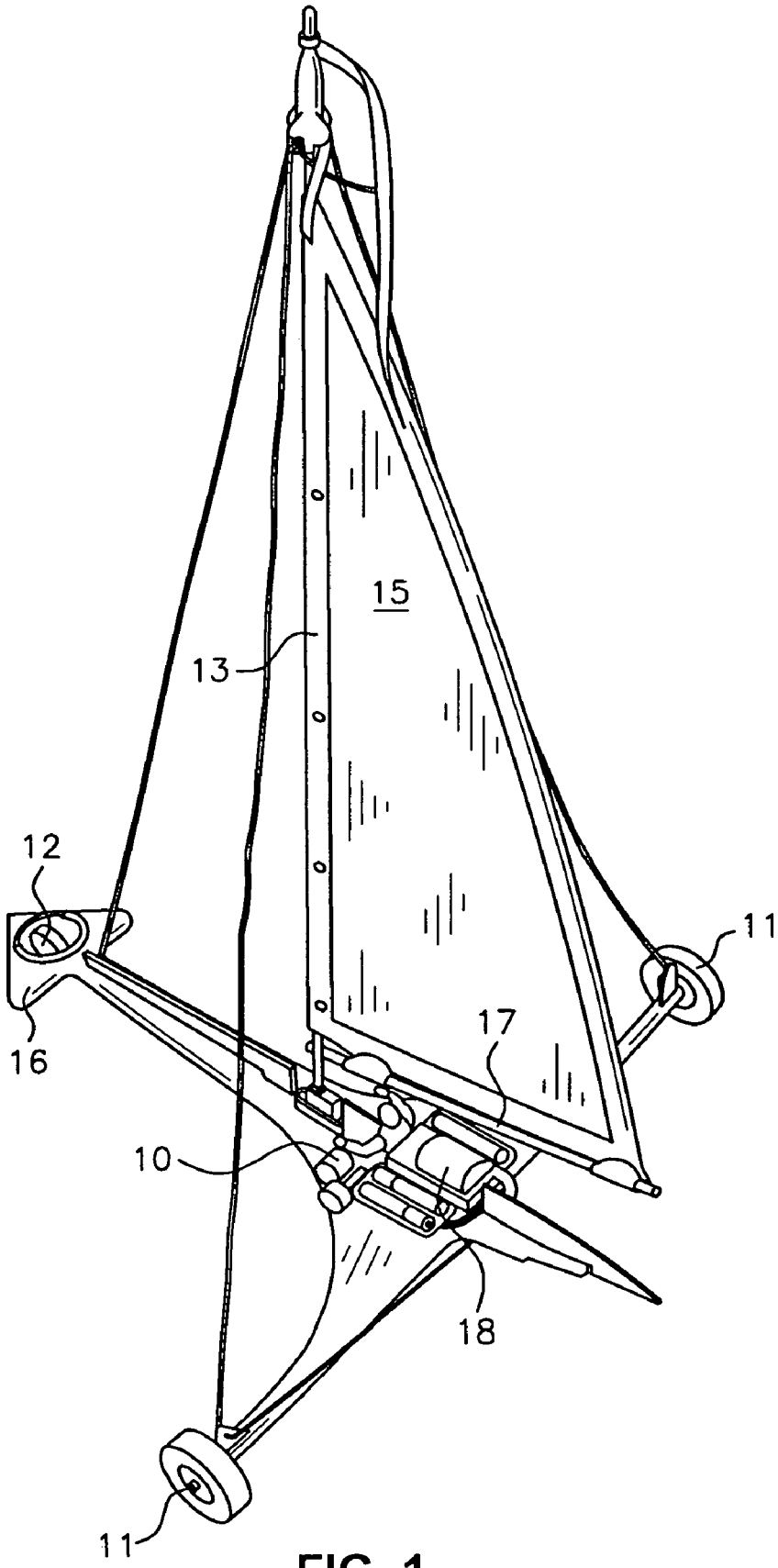
FIG. 1 is a top right rear isometric view of the land sail vehicle of the invention.

Referring to FIG. 1, the wind propelled toy vehicle of the invention is of the tricycle type and includes a frame 10 which rides on three wheels, two spaced apart rear wheels 11 and a steerable wheel 12 at the front. The frame supports a mast 13 which holds a sail 15 and a boom 17. The frame further carries a radio-controlled receiver and servomotors 18 which control the position of the sail and steer the front wheel. One of the unique aspects of the invention on the frame is a nosepiece 16 which forms a skid plate and a front bumper. As described further below, the skid plate includes side rails which lift the front wheel when the vehicle is heeled over too far preventing it from tipping over in high wind.

Figure 2A:
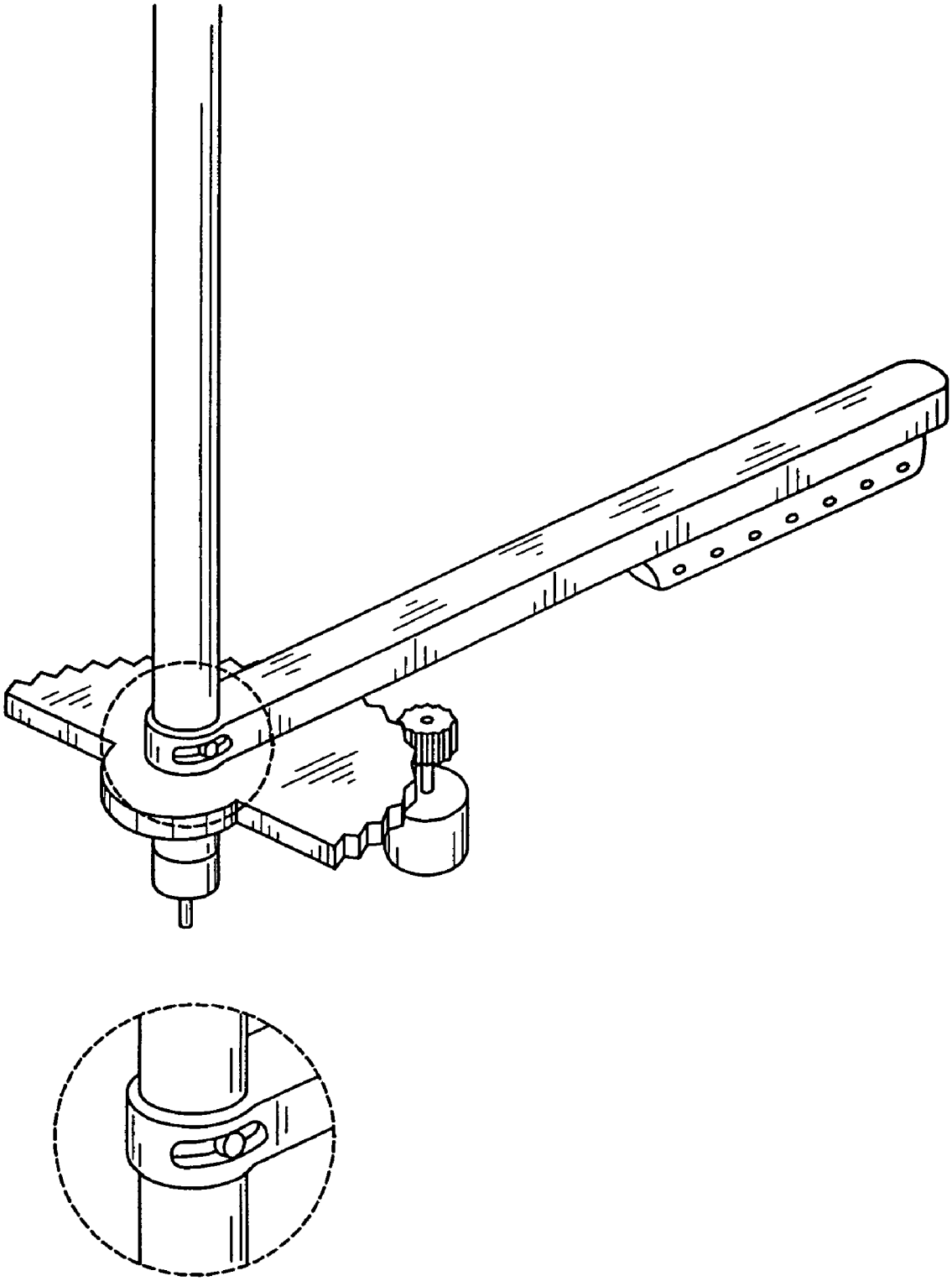
FIGS. 2A, 2B, 3, and 4 are top right front isometric views of alternate embodiments of the sail position control mechanism.
Figure 2B:
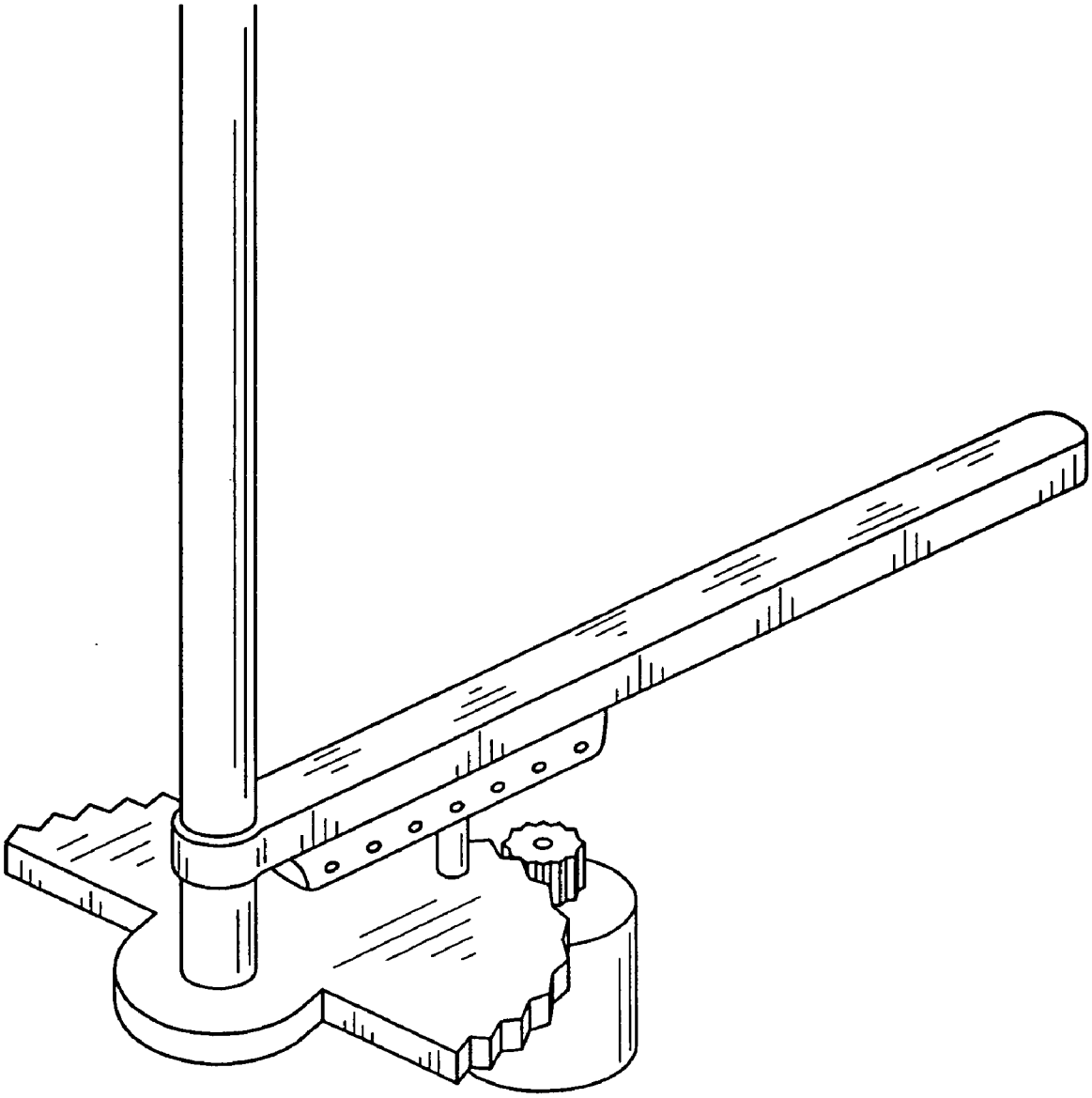

FIGS. 2A, 2B, 3, 4, and 4A represent different embodiments of unique sail position control mechanisms. Referring now to FIG. 2A, one embodiment utilizes a direct gear drive between the servomotor and the mast so that the mast may be rotated in response to remote control signals. The boom is pivotally attached to the mast with a limited range of free play provided by a slotted sleeve which engages a pin on the mast. This provides the desired ability to change the position of the sail while allowing a limited amount of free movement of the boom. Alternatively, as shown in FIG. 2B, the main gear may be connected directly to a freely rotatable boom with no free play between the drive mechanism and the boom.

Figure 3:
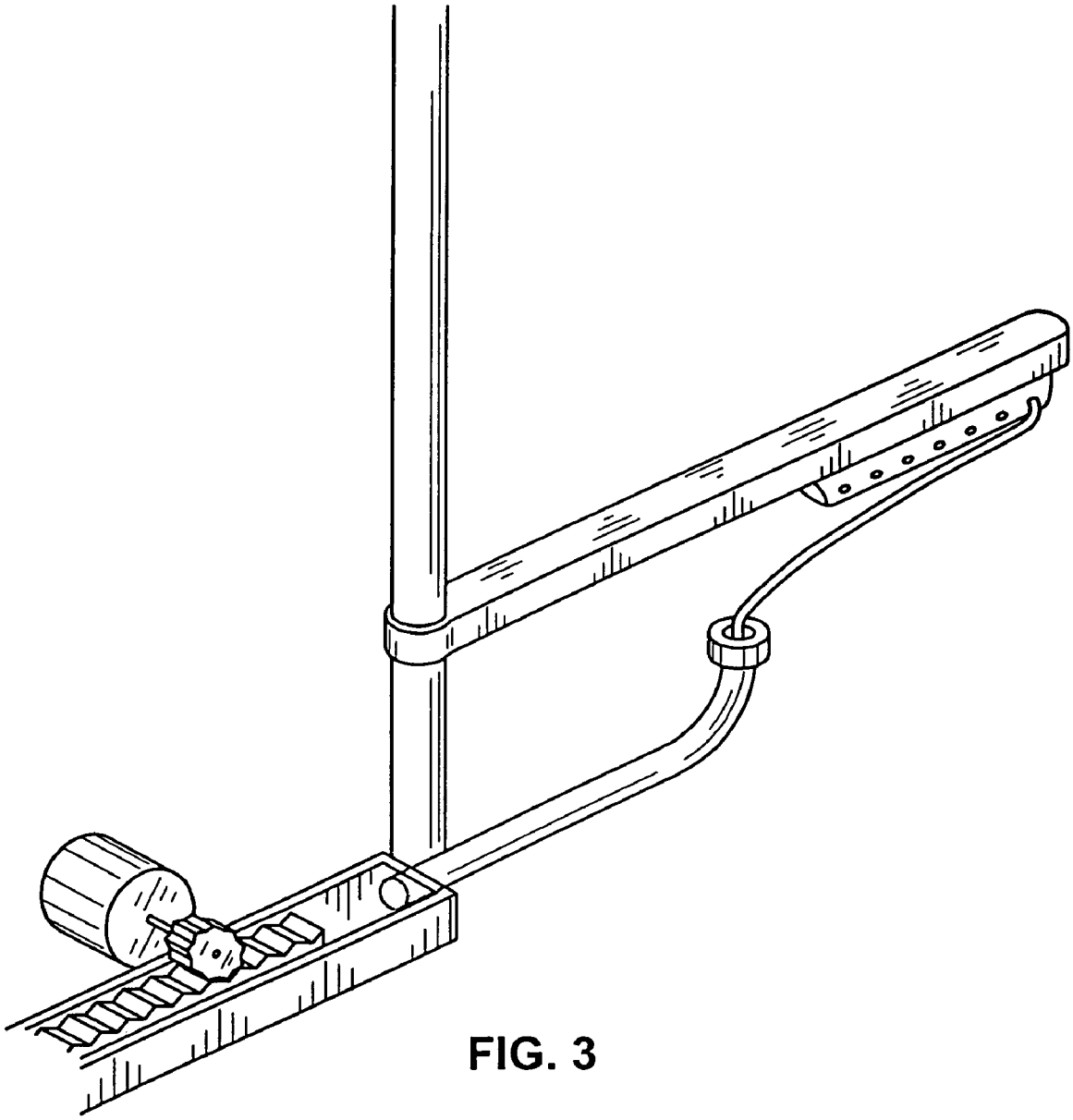

Referring now to FIG. 3, another embodiment includes a mechanism wherein the mast is rigidly affixed to the vehicle frame but the boom is rotatably affixed to the mast with rotational movement constrained only by a control cable. The path of the control cable is guided by tubular guide means on intermediate ends of the cable. One end of the cable is attached to a rail on the underside of the boom which has multiple alternate positions of attachment. The opposite end of the cable is connected to a linearly moving slide assembly which is gear driven by a servomotor. This mechanism allows the sail to be positioned relative to the frame by the length of the cable which is fed from the end of the guide tube, the movement of the sail being controlled solely by the wind which takes the sail in one direction or another to the degree permitted by the length of the cable. This arrangement provides a string-type controlled boom that eliminates the possibility of the string or cable becoming entangled and thus represents a major improvement over the prior art.

Figure 4:
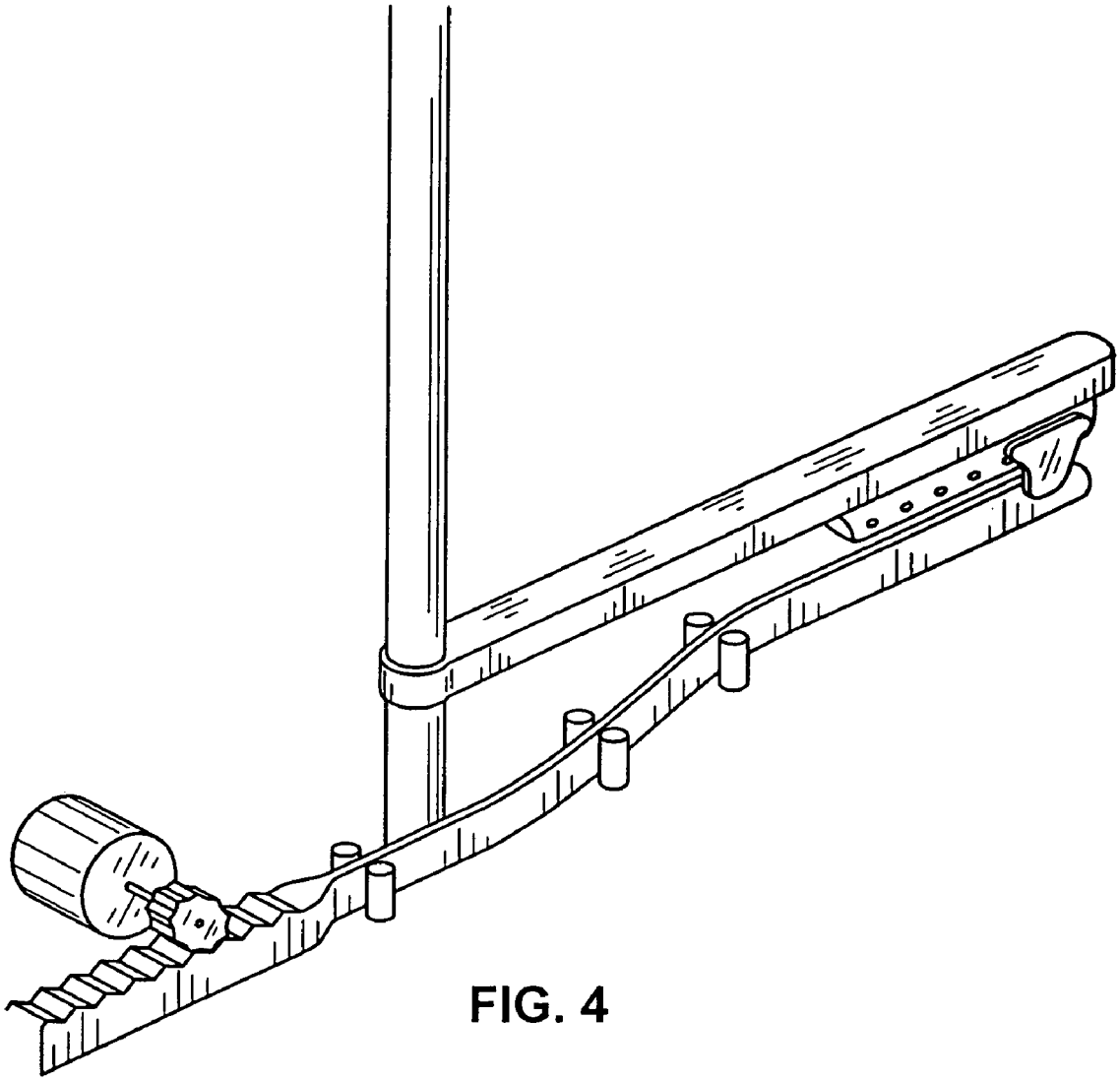
Figure 4A:
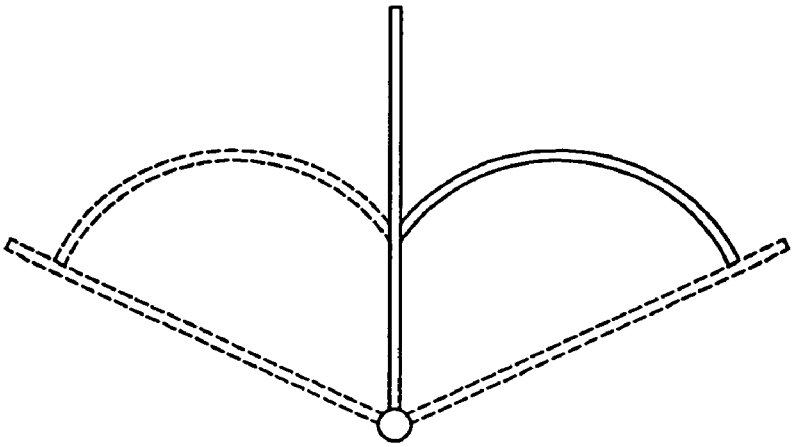
FIG. 4A is a top plan view depicting alternate positions of the sail utilizing an alternate embodiment of the invention.

Referring now to FIG. 4, yet another embodiment of the invention which permits accurate control of the sail position is depicted. Like the embodiment shown in FIG. 3, this embodiment utilizes a fixed mast with a freely rotatable boom. However, it utilizes a track on the underside of the boom for slidably securing one end of the position control element. Rather than a guided string, the central element is a resilient band. The material of the band is vertically rigid yet laterally deflectable like a leaf spring. The rail on the underside of the boom provides a track which engages a slide mechanism or shoe at the end of the band. A series of guide rollers or rails control the direction of the band which extends along the bottom of the boom. A gear-driven linear feed mechanism extends and retracts the band which resiliently controls the position of the sail as it is taken by the wind in one direction or the other. FIG. 4A depicts alternate positions of the band and the sail in its most extreme positions on one side and then the other. A unique aspect of this control mechanism compared to the embodiment shown in FIGS. 2A, 2B, and 3 is that it constantly provides a restorative force which urges the sail and the boom toward the center line position. The biasing force is greatest when the control band is fully retracted and the boom is held in the center position on the frame. This resilience allows the sail to self adjust in changeable or inconsistent gusting winds.

Figure 5:
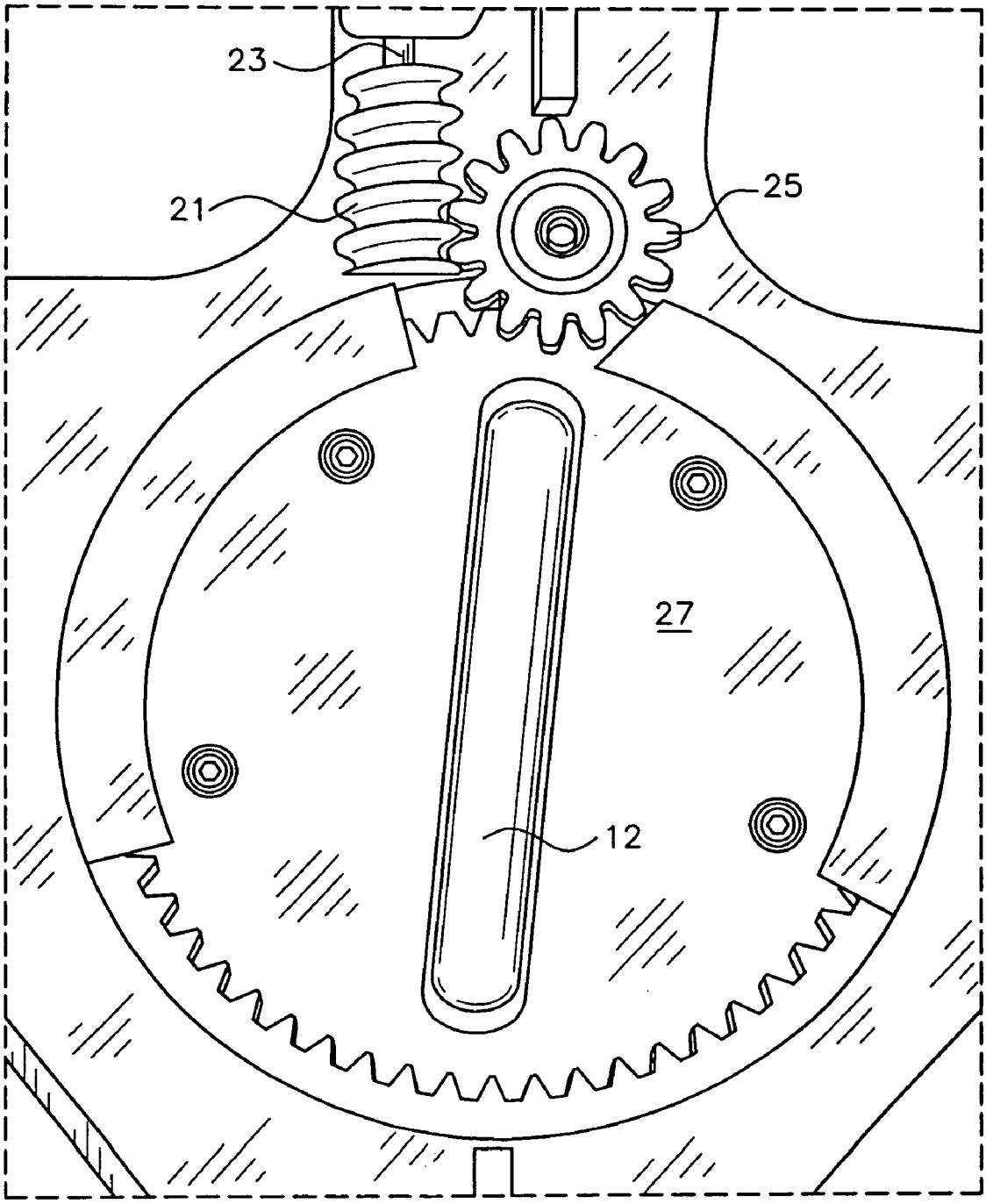
FIG. 5 is a top plan view of the front wheel steering mechanism.

FIG. 5 depicts a view from directly above the front wheel steering mechanism. As shown in this figure, worm gear 21 is turned by drive shaft 23 which extends rearward along the length of the frame to a servomotor. Worm gear 21 turns pinion gear 25 that meshes with planetary gear 27 that encircles front wheel 12. It will be readily understood by those of ordinary skill in the mechanical arts that this mechanism resists reverse force transfer from the wheel to the steering drive shaft. This effectively locks the wheel in the position determined by the drive shaft and the servomotor/receiver unit. Hence, accurate and highly-controlled maneuvering of the vehicle is provided.

Figure 6:
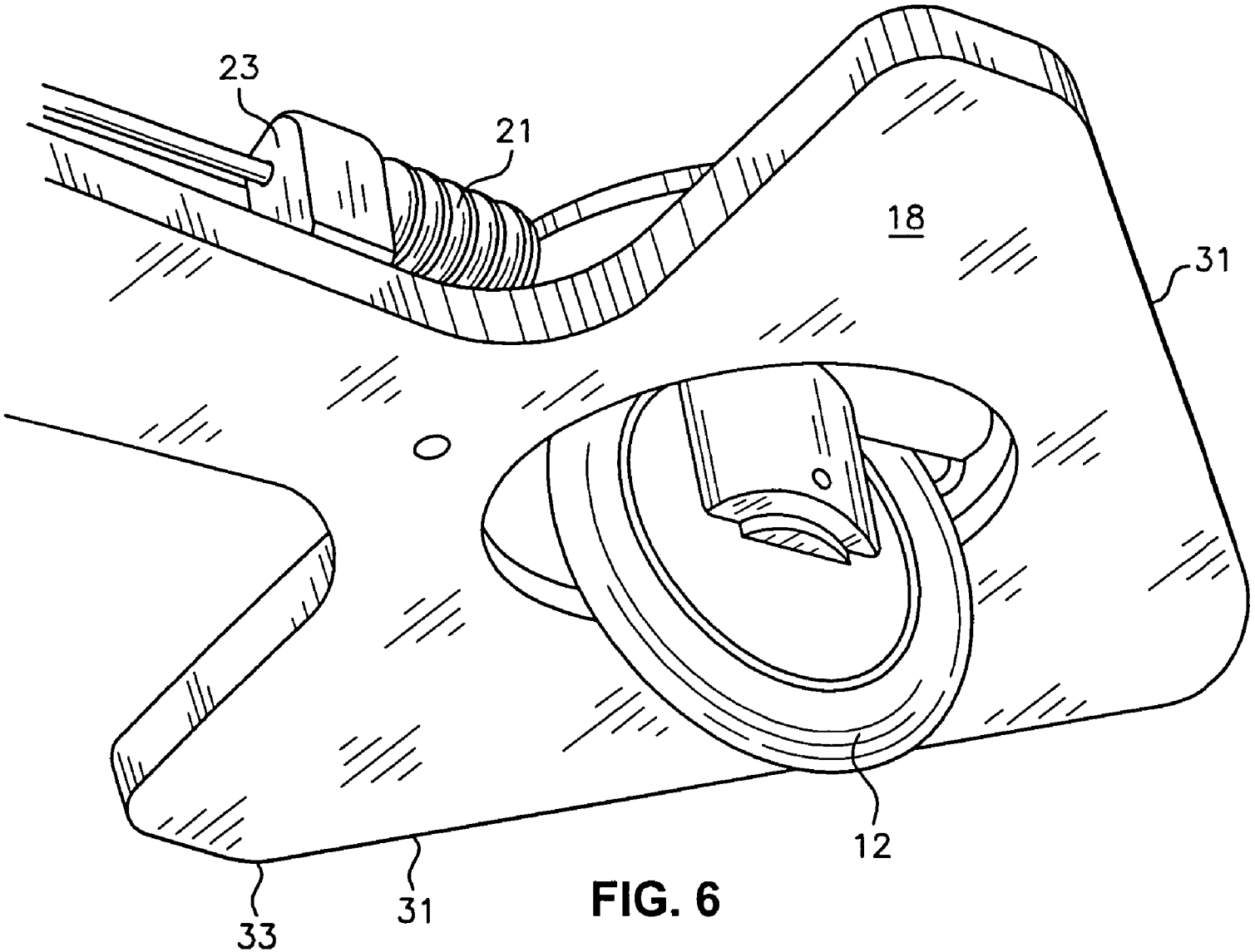
FIG. 6 is a right side elevation view of the skid plate of the vehicle when it is heeled over too far.

Referring now to FIG. 6, the operation of the skid plate which is another unique aspect of the invention is shown. One problem with wind sail vehicles of the present type is their tendency to tip over in a high wind, high speed situation. When this occurs, use of the vehicle is interrupted and the operator has to manually right the vehicle and reposition himself or herself to continue the operation by remote control. This is time consuming and greatly reduces the enjoyment of using the toy. As shown in FIG. 6, the skid plate 18 of the present invention avoids tip-over in a unique way. When the vehicle heels over to one side in a strong wind as shown in this figure, a guiderail portion 31 contacts the ground at point 33 and lifts the front wheel 12. This allows the front wheel to slide out in the direction of the wind thus rotating the entire vehicle and hence the sail in orientation of less attack with respect to the wind. This immediately rights the vehicle and permits it to resume normal operation without tipping over completely. Also shown in this figure are details of the steering mechanism including drive shaft 23 and worm gear 21.

It should be understood that there may be other modifications and changes to the present invention that will be obvious to those of skill in the art from the foregoing description, however, the present invention should be limited only by the following claims and their legal equivalents.

What is claimed is:

1. A remote-controlled wind propelled land vehicle comprising:

a frame having a rear portion including means for mounting two spaced apart coaxially aligned rear wheels;

means at a front portion of said frame for mounting a single steerable front wheel, said rear wheels and said front wheel providing rolling support for said frame along a ground surface;

a steering mechanism mounted to said frame for turning said front wheel about a substantially vertical axis;

remote control means including a receiver responsive to remote control signals mounted upon the rear portion of said frame for driving said steering mechanism;

a mast mounted to said frame for supporting an upright wind sail assembly including a swingably mounted boom connected to said mast and a sail;

said remote control means further comprising at least one motor for steering said front wheel and further including means for manipulating said boom in response to control signals generated by a remote control sending unit; and said steering mechanism comprises a forwardly-extending rotatable drive shaft having a worm gear at a forward end thereof meshing with a planetary gear of said steering mechanism, said drive shaft having a rearward end connected to said remote control means.

2. The vehicle of claim 1 wherein said boom manipulating means comprises a guided cable which passes through a tubular guide along a substantial portion of its length, said cable attached to said boom at one end and attached to said remote control means at a second end thereof.

3. The vehicle of claim 2 wherein said tubular guide is affixed to said frame.

4. The vehicle of claim 3 wherein said tubular guide is a substantially circular cross-section.

5. The vehicle of claim 1 wherein said boom is swingably mounted to said mast and said mast is pivotably mounted to said frame.

6. The vehicle of claim 5 further including a partially restrictive rotatable joint between said boom and said mast, said joint including an arcuate slot in a collar which surrounds said mast and which is rigidly connected to said boom, said joint further including a pin rigidly affixed to said mast which projects laterally through said slot whereby said pin engages ends of said slot when said boom swings from one side to the other about said mast.

7. The vehicle of claim 6 wherein said means for manipulating said boom includes first gear means affixed to said mast, said first gear means being in meshing cooperation with second gear means connected to said remote control means.

8. The vehicle of claim 7 wherein said first gear means is connected to said mast along a bottom portion thereof.

9. The vehicle of claim 1 wherein said means for manipulating said boom comprises a DC electric motor.

10. The vehicle of claim 1 wherein said planetary gear lies substantially in a horizontal plane and includes teeth which surround the front wheel on all sides.

11. A remote-controlled wind propelled land vehicle comprising:

a frame having a rear portion including means for mounting two spaced apart coaxially aligned rear wheels;

means at a front portion of said frame for mounting a single steerable front wheel, said rear wheels and said front wheel providing rolling support for said frame along a ground surface;

a steering mechanism mounted to said frame for turning said front wheel about a substantially vertical axis;

remote control means including a receiver responsive to remote control signals mounted upon the rear portion of said frame for driving said steering mechanism;

a mast mounted to said frame for supporting an upright wind sail assembly including a swingably mounted boom connected to said mast and a sail;

said remote control means further comprising at least one motor for steering said front wheel and further including means for manipulating said boom in response to control signals generated by a remote control sending unit; and wherein said means for manipulating said boom comprises an extendable and retractable leaf spring.

12. The vehicle of claim 11 wherein said remote control means includes drive means between at least one motor and said leaf spring for extending and retracting said leaf spring forwardly and rearwardly beneath said boom.

13. The vehicle of claim 12 further including a coupling slidably connected to said boom at one end and rigidly connected to a distal end of said spring at the other end whereby retracting and extending said spring resiliently restricts lateral movement of said boom to a greater or lesser degree.

14. A remote-controlled wind propelled land vehicle comprising:

a frame having a rear portion including means for mounting two spaced apart coaxially aligned rear wheels;

means at a front portion of said frame for mounting a single steerable front wheel, said rear wheels and said front wheel providing rolling support for said frame along a ground surface;

a steering mechanism mounted to said frame for turning said front wheel about a substantially vertical axis;

remote control means including a receiver responsive to remote control signals mounted upon the rear portion of said frame for driving said steering mechanism;

a mast mounted to said frame for supporting an upright wind sail assembly including a swingably mounted boom connected to said mast and a sail;

said remote control means further comprising at least one motor for steering said front wheel and further including means for manipulating said boom in response to control signals generated by a remote control sending unit; and a skid plate affixed to said frame located proximate the front wheel, said skid plate including left side and right side surfaces which are ground engagable when said vehicle is traveling in a heeled over condition, each surface extending laterally beyond a line between said front wheel and each rear wheel.

* * * * *